US005909761A

United States Patent [19]

Murray

[11] Patent Number: 5,909,761

[45] Date of Patent: Jun. 8, 1999

[54] COMBINATION AWNING CLAMP AND RAFTER ARM LOCK WITH CANOPY TENSIONING CAPABILITIES

[75] Inventor: Brent W. Murray, Longmont, Colo.

[73] Assignee: Carefree/Scott Fetzer Company, Broomfield, Colo.

[21] Appl. No.: 08/976,735

[22] Filed: Nov. 24, 1997

Related U.S. Application Data

[ 60] Provisional application No. 60/031,608, Nov. 27, 1996.

[51] Int. Cl.[6] ..... E04F 10/06

[52] U.S. Cl. ..... 160/71; 160/80; 248/229.13

[58] Field of Search ..... 160/66, 67, 69, 160/70, 71, 78, 79, 80; 135/88.11, 88.12; 24/335, 369, 525, 527; 248/229.13, 229.23, 316.1, 316.5

[56] References Cited

U.S. PATENT DOCUMENTS 5,314,153 5/1994 White ..... 160/67
5,369,850 12/1994 Noble .
5,592,982 1/1997 Murray et al. .

*Primary Examiner*—Blair M. Johnson
*Attorney, Agent, or Firm*—Dorsey & Whitney LLP

[57] ABSTRACT

A system for automatically tensioning an awning canopy while deploying a clamp arm for operative engagement with the side edge of an awning canopy, includes a clamp arm pivotally mounted on the outermost component of a telescoping rafter arm also having an innermost component. The innermost component slidably receives a gripping system that engages the inner component and becomes releasably locked thereto upon initial pivotal movement of the clamp arm. A link arm interconnects the clamp arm with the outer telescoping component such that further pivotal movement of the clamp arm causes a longitudinal extension of the rafter arm to apply tension to the awning canopy.

11 Claims, 4 Drawing Sheets

COMBINATION AWNING CLAMP AND RAFTER ARM LOCK WITH CANOPY TENSIONING CAPABILITIES

CROSS REFERENCE TO RELATED APPLICATION

This application claims priority to provisional application Ser. No. 60/031,608 filed Nov. 27, 1996 for Combination Retractable Awning Clamp and Tensioning System.

BACKGROUND OF THE INVENTION

1. Field of the Invention

The present invention relates generally to retractable awnings, and more particularly to a stabilizing clamp adapted to minimize slapping of the awning canopy during inclement weather while simultaneously tensioning the awning canopy.

2. Description of the Prior Art

Retractable awnings have been utilized for many years to provide shade or other protection to doorways and windows or to overlie an area adjacent to a building structure, such as a patio, deck or the like. More recently, retractable awnings have been mounted on movable structures such as travel trailers, mobile homes, recreational vehicles and the like.

In any of the above uses, however, a prevalent problem has been damage to the canopy of the awning caused when inclement weather conditions, such as high winds, cause the canopy to flap thereby tearing the canopy fabric.

Most, if not all, retractable awnings include rafter arms which extend from a support surface for the awning to the outer edge of the awning canopy when the awning is extended. Rafter arms typically include two telescoping members which are longitudinally adjustable to accommodate extension and retraction of the awning. Systems have been developed for mechanically extending the length of awning rafters so as to desirably tension the awning canopy when it is extended. Also, systems have been devised for interconnecting a rafter arm to the awning canopy to inhibit flapping of the awning canopy in inclement weather conditions. An example of such a clamp is shown in co-pending application Ser. No. 08/613,228 entitled "Stabilizing Clamp for Canopy of a Retractable Awning" filed Mar. 8, 1996, which is of common ownership with the present application. Further, systems are commonly employed for locking the longitudinal relationship of the telescoping members once the awning is fully extended.

While not known in the art to applicant's knowledge, a desirable accessory for retractable awnings would reside in a device or system providing a means for gripping the awning canopy to prevent flapping and simultaneously lock the longitudinal relationship of the telescoping members and tension the canopy.

It is to this end that the present invention has been developed.

SUMMARY OF THE INVENTION

The present invention is directed to a combination awning clamp, locking, and tensioning system. A clamp member is pivotally mounted on an awning rafter such that upon pivotal movement of the clamp member, the telescoping rafter arm components are simultaneously extended relative to each other to tension the awning sheet operatively connected thereto, fixed in their longitudinal relationship and the clamp member is moved into a position to grip the awning fabric to secure the fabric.

Rafter arms are typically comprised of inner and outer telescoping components which slide longitudinally of each other upon extension and retraction of the awning. In accordance with the present invention, the inner and outer rafter components have a non-circular transverse configuration so as to remain non-pivotal about their longitudinal axes.

A clamp member which may be substantially similar to the clamp shown in the above-noted U.S. application Ser. No. 08/613,228, which is hereby incorporated by reference, is pivotally connected to the inner telescoping member by a link arm which is in turn pivotally connected to the outer telescoping member. A gripping system is slidably disposed internally of the inner telescoping member and also operatively connected to the clamp member. The clamp member has two pivots at one end thereof with one pivot anchoring the gripping system and the other pivot being disposed on a free or swinging end of the link arm. The link arm is also pivoted to the outer telescoping member at the end of the outer telescoping member that overlaps the inner member.

When the awning is stored the clamp member is aligned with the rafter arm but the dual pivotal mounting of the clamp member allows it to be pivoted approximately 90° relative to the rafter arm so as to project toward the awning canopy where it can grip an edge of the awning canopy pursuant to the disclosure in the above-noted pending application. Simultaneously with the pivoting movement, the gripping member is activated so that the clamp member is releasably and selectively secured to the inner telescoping member such that further pivotal movement causes the clamp member to exert pressure on the link arm thereby longitudinally sliding the inner telescoping member relative to the outer telescoping member which stretches or places further tension in the awning canopy and fixes the longitudinal relationship of the telescoping members.

As the rafter arm is being lengthened, thereby stretching the awning canopy, the link arm is also simultaneously being pivoted until a stop on the link arm prevents further pivotal movement. The pivotal movement of the link arm is not terminated, by design, until the link arm has become slightly over center to provide a releasable lock to maintain the extended relationship between the inner and outer telescoping members.

Other aspects, features and details of the present invention can be more completely understood by reference to the following detailed description of a preferred embodiment, taken in conjunction with the drawings and from the appended claims.

DESCRIPTION OF THE PREFERRED EMBODIMENT

Figure 1:
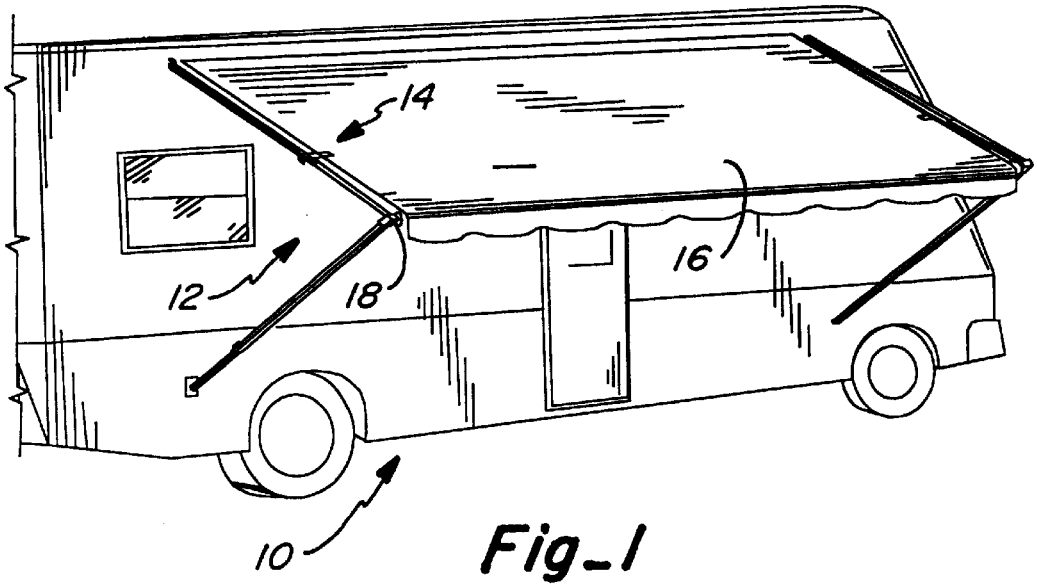
FIG. 1 is a fragmentary isometric view of a recreational vehicle having a retractable awning with the awning clamp of the present invention incorporated therein.
Figure 2:
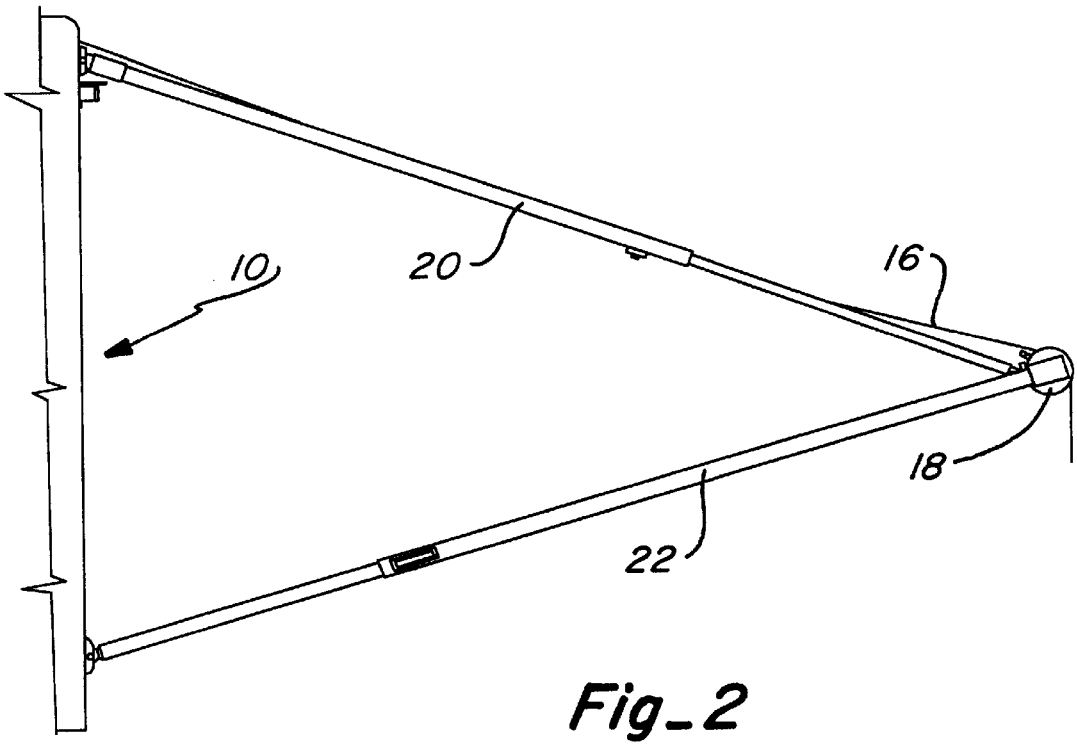
FIG. 2 is a fragmentary enlarged left side elevation of the awning as shown in FIG. 1.

FIG. 1 shows a recreational vehicle 10 having an awning 12 with the awning clamp and tensioning system 14 of the present invention incorporated therein. As can be appreciated, the retractable awning has an awning sheet 16 with an inner edge secured to the side wall of the vehicle and the outer edge secured to a roll bar 18 about which the awning sheet can be wrapped. The awning is shown in the extended position with a pair of rafter arms 20 and support arms 22 holding the awning in the extended position. The rafter arms and support arms are each telescoping and include inner and outer elements such that as the awning is moved into its extended position, the support arms and rafter arms telescopically lengthen to accommodate the extension of the awning. The system of the present invention is incorporated into the rafter arms as shown in FIGS. 3 through 8.

Figure 9:
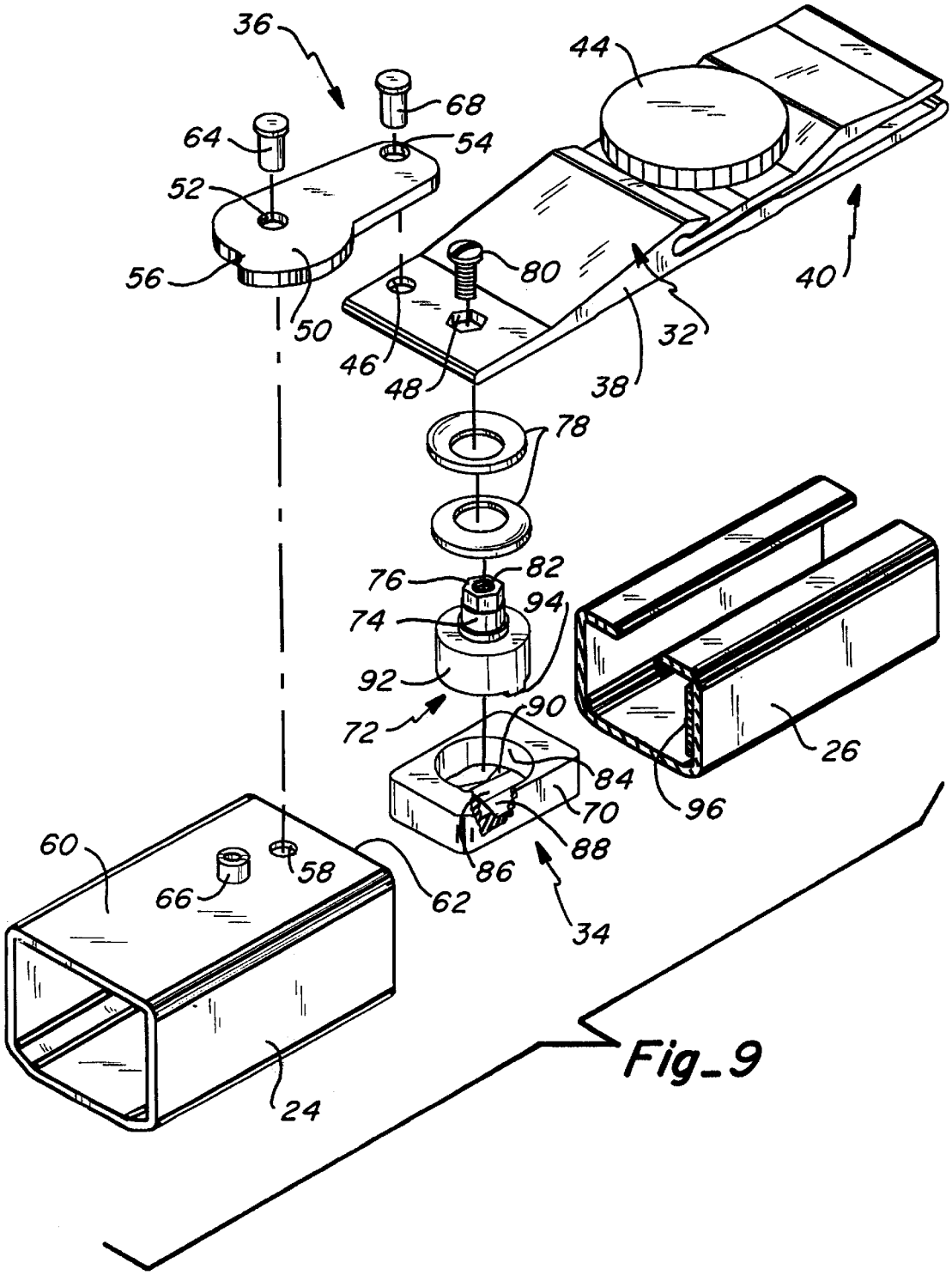
FIG. 9 is an isometric exploded view of the awning clamp and the rafter arm on which it is mounted.

As will be appreciated, the outer telescoping member 24 of the rafter arm 20 is of substantially square tubular configuration and the inner telescoping member 26 is also of generally square tubular configuration with a longitudinal slot 28 provided in its upper wall 30. Of course, the cross-sectional size of the inner member 26 is slightly less than the cross-sectional size of the outer member 24 so that the inner member is slidable within the outer member. The clamp and tensioning system 14 of the present invention is incorporated into the rafter arm at the outermost overlap of the outer member 24 with the inner member 26. The clamp and tensioning system includes a clamp arm or element 32 that is pivotally connected to both a gripping system 34 (FIGS. 5, 6 and 9) disposed within the interior of the inner telescoping member and a link arm system 36 connected to the outer telescoping member.

The clamp arm 32 is similar to the clamp described in the afore-noted copending application Ser. No. 08/613,228 which, as mentioned previously, is hereby incorporated by reference. The clamp arm is an elongated bar 38 having an alligator jaw-type clamp or clip 40 at its free end which is adapted to receive the adjacent side edge 42 of the awning canopy 16 and a gripping knob 44 adapted to compress the jaws of the clamp to secure the awning sheet therebetween. The opposite end of the clamp arm 32 has a pair of transversely aligned openings therethrough (FIG. 9) with one opening 46 being circular in cross-section and the other 48 non-circular. In the illustrated embodiment the non-circular opening is hexagonal in configuration.

The link arm system 36 includes an elongated link arm 50 having a pair of spaced circular openings 52 and 54 (FIG. 9) therethrough and an indentation 56 along one peripheral surface defining an over center stop. The opening 52 in the link arm is alignable with an opening 58 in the top wall 60 of the outer telescoping member 24 adjacent the outer end 62 of the member so that a pivot pin 64 can be secured through the link arm and the outer telescoping member to pivotally mount the link arm on the outer telescoping member. An upwardly protruding abutment 66 is provided on the top wall 60 of the outer telescoping member in the path of movement of the indentation 56 in the link arm such that pivotal movement of the link arm is prevented at a predetermined degree of motion to be described in more detail hereafter. The circular opening 54 through the link arm is alignable with the circular opening 46 through the clamp arm 32 so as to receive a second pivot pin 68 which permits pivotal movement between the link arm and the clamp arm.

The gripping system 34 which is disposed internally of the inner telescoping member 26 includes a gripping block 70, a cam element 72 having an upwardly directed centrally located shaft 74 with a hexagonal cross-sectional configuration at its uppermost end 76, a pair of spring washers 78 disposed about the shaft 74 and a threaded fastener 80 adapted to be received in an axial threaded recess 82 in the top of the shaft.

The gripping block 70 is substantially rectangular in configuration having a width that substantially corresponds with the internal width of the inner telescoping member 26. The gripping block is thereby prevented from rotating within the inner telescoping member. The gripping block has a cylindrical recess 84 in its top surface and a diametrical groove 86 in the bottom wall 88 of the recess. The diametrical groove has tapered or beveled side walls 90 which vary in width with the bevel being substantially nil at the longitudinal center of the groove and the widest at opposite ends of the groove.

The cam element 72 has a generally cylindrical main body 92 with a diametrical rib 94 protruding from its bottom surface and with the shaft 74 protruding upwardly from its upper surface. As mentioned, the shaft 74 has a hexagonal transverse cross section at the top adapted to mate with the hexagonal opening 48 in the clamp arm 32. The spring washers 78, commonly referred to as Belvell washers, are positioned on the shaft 74 in confronting relationship and the assemblage of the gripping block 70, cam element 72 and spring washers 78 is positioned within the inner telescoping member 26. The screw fastener 80 is then advanced through the hexagonal opening in the clamp element and threaded into the threaded recess 82 in the shaft so as to secure the gripping system 34 to the clamp arm 32.

Figure 3:
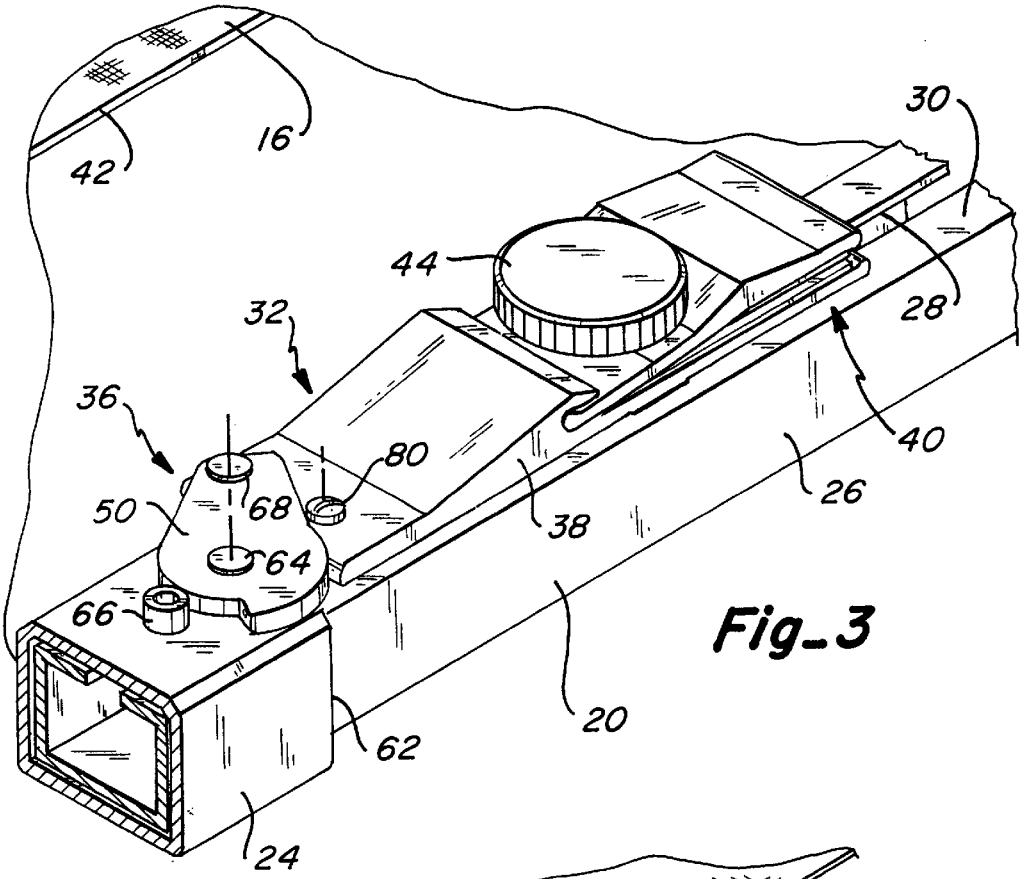
FIG. 3 is a fragmentary isometric showing the awning clamp of the present invention mounted on a rafter arm for a retractable awning.

In operation, and referring first to the gripping system 34, when the clamp arm 32 is longitudinally aligned with the rafter arm 20, as when it is in its storage position of FIG. 3, the diametrical rib 94 on the bottom of the cam element 72 is positioned within the groove 86 formed in the bottom wall 88 of the cylindrical recess 84 in the gripping block. In this position, the entire assemblage of the gripping block, cam element and spring washers is loosely fit within the interior of the inner telescoping member so that the assemblage is free to slide longitudinally of the inner telescoping member. A low coefficient of friction bearing plate 96 is also positioned within the inner telescoping member adjacent one side of the inner telescoping member against which the afore-noted assemblage of parts can bear during operation of the gripping system. The low coefficient of friction bearing plate can be a plastic, Teflon-coated member or any other suitable member that allows low-friction sliding movement between relative moving parts.

Pivotal movement of the clamp arm 32 in a counter clockwise direction, as viewed in FIGS. 3, 4, 7 and 8, will cause the cam element 72 to pivot relative to the gripping block 70 due to the hexagonal mating of the shaft 74 with the opening 48 in the clamp arm. The beveled or tapered side walls 90 of the groove 86 in the gripping block permit rotation of the cam element within the gripping block causing the diametrical rib to ride up on the beveled walls and into overlying relationship with the bottom wall 88 of the cylindrical recess 84 in the gripping block. This movement, of course, axially separates the cam element from the gripping block which compresses the spring washers against the inner surface of the top wall 30 of the inner telescoping member thereby yieldingly forcing the gripping block against the bottom wall of the inner telescoping member. The gripping system accordingly becomes positively but releasably positioned within the inner telescoping member. The bearing plate 96 is positioned on the side of the inner telescoping member against which the assemblage is pushed as a result of the counter clockwise rotation of the clamp arm 32. The gripping system 34 is positively locked within the interior of the inner telescoping member upon approximately a 15° rotation of the clamp arm.

Figure 7:
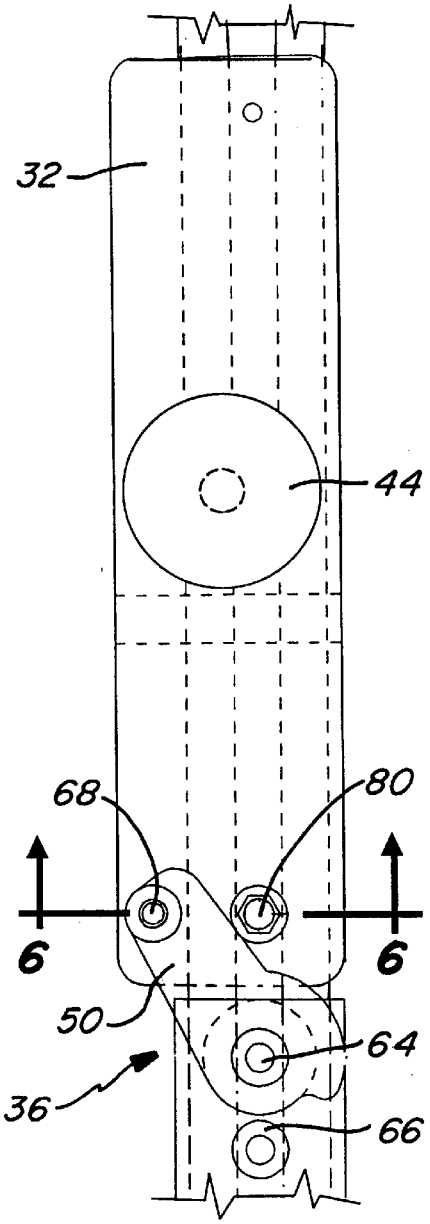
FIG. 7 is a fragmentary top plan view of the awning clamp of the invention mounted on a rafter arm and with the clamp in a stored position.
Figure 8:
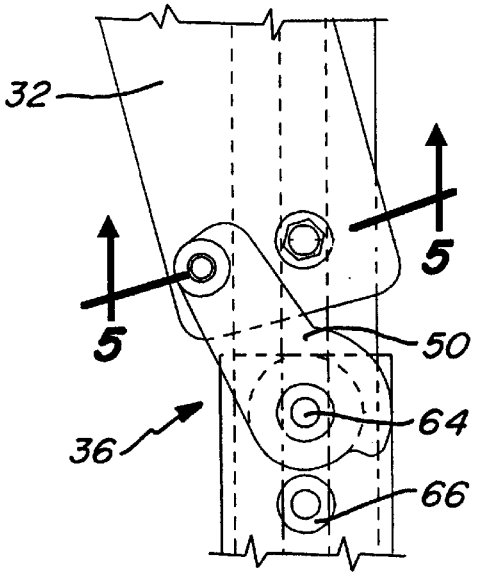
FIG. 8 is a fragmentary top plan view of the awning clamp mounted on a rafter arm and with the clamp in a partially extended position.

Looking next at FIGS. 7 and 8, the link arm system 36 can also be seen to be effected by pivotal movement of the clamp arm 32. Counter clockwise rotation of the clamp arm causes the link arm to pivot about its pivotal connection with the clamp arm and simultaneously cause the link arm to pivot about its connection to the outer telescoping member 24. This movement simultaneously causes a longitudinal displacement between the shaft 74 of the cam element and the pivot pin 64 that interconnects the link arm with the outer telescoping member. Thus, counter clockwise rotation of the clamp arm 32 initially causes the gripping system 34 to slide the inner telescoping member longitudinally away from the outer telescoping member thereby effectively lengthening the rafter arm 20 and tensioning the awning canopy 16 and also fixing the longitudinal relationship between the inner and outer telescoping members.

Figure 4:
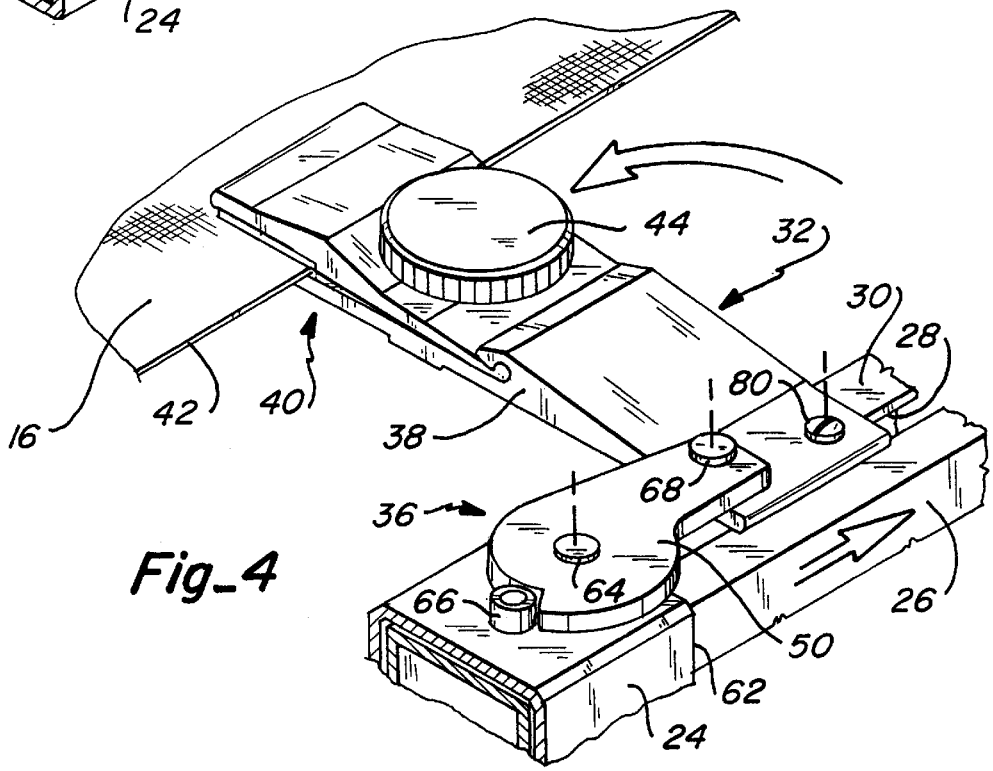
FIG. 4 is a fragmentary isometric similar to FIG. 3 with the awning clamp in an extended position.
Figure 5:
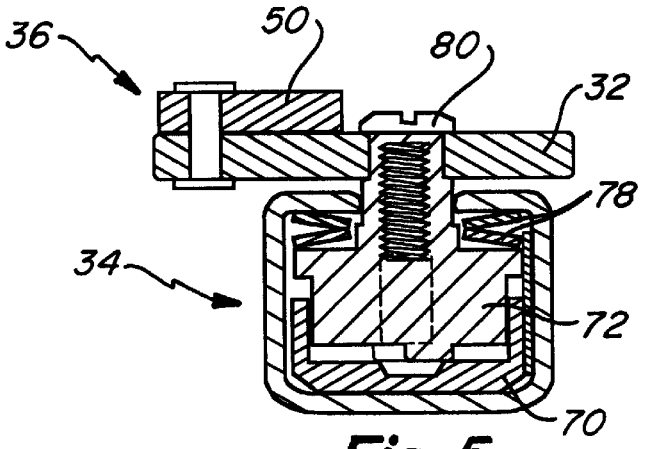
FIG. 5 is an enlarged section taken along line 5—5 of FIG. 8.
Figure 6:
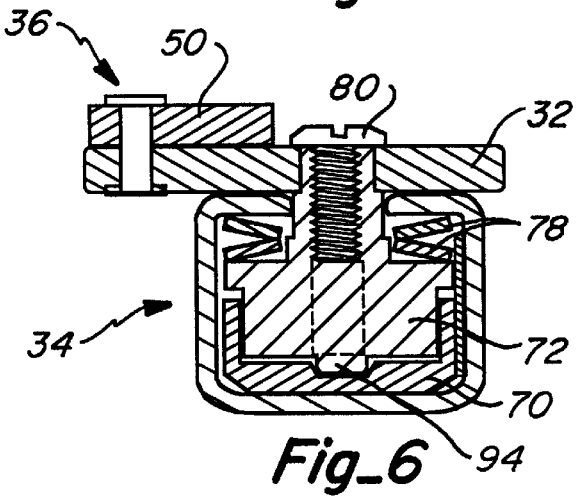
FIG. 6 is an enlarged section taken along line 6—6 of FIG. 7.

The system has been designed so that a counter clockwise rotation of the clamp arm 32 approximately 90° causes the link arm 50 to pivot until the abutment 66 is engaged by the indentation 56 on the link arm, at which point the pivot pin 68 connecting the link arm to the clamp arm has passed slightly beyond the longitudinal center of the rafter arm (FIG. 4). The clamp arm is thereby yieldingly retained in its perpendicular relationship to the rafter arm by the over center relationship of the link arm with the rafter arm.

It has been found that counter clockwise rotation of the clamp arm from its stored position in alignment with the rafter arm to its fully deployed position that is substantially perpendicular to the rafter arm causes a lengthening of the associated rafter arm 20 approximately one inch which is ideal for providing the added tension in an awning sheet 16 that is desired from that which is obtained through the normal manual movement of a retractable awning from its retracted to extended position.

Although the present invention has been described with a certain degree of particularity, it is understood that the present disclosure has been made by way of example, and changes in detail or structure may be made without departing from the spirit of the invention as defined in the appended claims.

I claim:

1. A clamp for stabilizing the canopy of a retractable awning wherein the retractable awning is mounted on a support surface so as to be movable between extended and retracted positions, said awning including a canopy having an inner edge operatively connected to said support surface, an outer edge positionable away from said support surface when the awning is extended and a pair of side edges, a pair of rafter arms having longitudinally slidable inner and outer elements with the inner elements having an inner end operatively secured to the supporting surface and the outer elements having an outer end movable away from the supporting surface and operatively supporting said outer edge of the canopy such that the rafter arms extend in closely adjacent relationship to said side edges of the canopy when the awning is extended, said clamp being mounted upon at least one of said rafter arms and comprising in combination:

a base pivotally connected to said rafter arm and movable between a use position and a non-use position, said base including a clip adapted to releasably grip a side edge of said canopy in said use position to substantially immobilize said side edge relative to said rafter arm at the location where said side edge is gripped by said clip, and a lock for positively but releasably fixing the longitudinal relationship of said inner and outer elements of the rafter arm to which the clamp is connected.

2. The clamp of claim 1 wherein said lock includes means for automatically fixing the longitudinal relationship of the inner and outer rafter elements of said rafter to which the clamp is connected as said base is pivotally moved between its non-use and use positions.

3. The clamp of claim 2 wherein said base is connected to one of said inner and outer elements with a link and is selectively slidably connected to the other of said inner and outer elements, and wherein said lock is operable to selectively fix said base relative to said other of said elements to prevent the base from sliding relative to said other element.

4. The clamp of claim 3 wherein said lock includes a gripping block in selective sliding engagement with said other element and a cam system operably connected to said base to compress said gripping block into frictional locking engagement with said other element as said base is moved from its non-use to its use position.

5. The clamp of claim 4 wherein said cam system includes a cam element keyed to said base for uniting pivotal movement therewith, said cam element being in engagement with said gripping block and adapted to compress said gripping block against said other element upon pivotal movement of said base from its non-use to its use position.

6. The clamp of claim 5 wherein said other element is tubular in configuration and said gripping block and cam element are positioned within said other element.

7. The clamp of claim 6 wherein said other element has opposing walls and wherein said gripping block is in selective sliding engagement with one of said opposing walls and further including resilient means adjacent the other of said opposing walls yieldingly biasing said cam element against said gripping block.

8. The clamp of claim 1 wherein said lock further includes extension means for extending the length of said rafter arm to which the clamp is connected as said base is moved between its non-use and its use position.

9. The clamp of claim 8 wherein said base is connected to one of said inner and outer elements with a link and is selectively slidably connected to the other of said inner and outer elements, and wherein said lock is operable to selectively fix said base relative to said other of said elements and move said elements longitudinally of each other to lengthen the associated rafter as said base is moved from its non-use to its use position.

10. The clamp of claim 9 wherein said link is pivotally connected to said base and to said one element such that upon pivotal movement of said base from its non-use to its use position, said link is pivoted relative to said base and said one of said elements causing said inner and outer elements to move longitudinally of each other to lengthen the associated rafter.

11. The clamp of claim 10 wherein pivotal movement of said base from its non-use to its use position causes said lock to initially fix said base relative to said other element and subsequently move said inner and outer elements longitudinally of each other to extend the associated rafter.

* * * * *